United States Patent [19]

Bührmann

[11] 4,427,186

[45] Jan. 24, 1984

[54] LIQUID-COOLED LANCE FOR BLOWING OXYGEN ONTO A STEEL BATH

[75] Inventor: Gerardus P. Bührmann, Velsen-Zuid, Netherlands

[73] Assignee: Estel Hoogovens B.V., Ijmuiden, Netherlands

[21] Appl. No.: 423,440

[22] Filed: Sep. 24, 1982

[30] Foreign Application Priority Data

Oct. 1, 1981 [NL] Netherlands ..... 8104474

[51] Int. Cl.[3] ..... C21C 5/32

[52] U.S. Cl. ..... 266/225; 266/270; 239/132.3

[58] Field of Search ..... 266/268, 270, 217, 221, 266/225; 239/132.3, 549; 75/60

[56] References Cited

U.S. PATENT DOCUMENTS

| | | | |
|---|---|---|---|
| 2,214,612 | 9/1940 | Greenberg | 266/225 |
| 3,082,997 | 3/1963 | Kurzinski | 266/225 |
| 3,337,203 | 8/1967 | Smith et al. | 239/132.3 |
| 3,488,044 | 1/1970 | Shepherd | 239/132.3 |
| 3,645,520 | 2/1972 | Acre et al. | 266/225 |
| 3,730,505 | 5/1973 | Ramacciotti et al. | 239/132.3 |

FOREIGN PATENT DOCUMENTS

| | | | |
|---|---|---|---|
| 1064970 | 9/1959 | Fed. Rep. of Germany | 266/225 |

*Primary Examiner*—L. Dewayne Rutledge
*Assistant Examiner*—Robert McDowell
*Attorney, Agent, or Firm*—Stevens, Davis, Miller & Mosher

[57] ABSTRACT

A liquid cooled lance is used to blow a primary supply of oxygen at the surface of a molten steel bath to form a burning spot. a central duct in the lance delivers the primary supply of oxygen to the tip. A secondary supply of oxygen is blown from nozzles around the side of the lance to burn up CO from the burning spot and so heat the bath. Several conduits run in parallel within the lance to deliver the secondary oxygen to the nozzles. There is preferably one conduit per nozzle. The conduits may run within an annular coolant duct, and preferably comprise, at least in part, pipes in the form of a winding around the lance axis. This construction has good resistance to thermal expansion stresses.

13 Claims, 3 Drawing Figures

LIQUID-COOLED LANCE FOR BLOWING OXYGEN ONTO A STEEL BATH

BACKGROUND OF THE INVENTION

1. Field of the Invention

The invention relates to a liquid-cooled lance for blowing oxygen onto a steel bath.

2. Description of the Prior Art

Oxygen lances are in general use in the steel industry for the refining of steel in furnaces of the L.D. converter type. Oxygen under high pressure is blown onto the bath, with carbon and possibly other undesired elements in the steel being burned at the so-called burning spot thus created. The carbon is converted into a mixture of CO and $CO_2$ and these gaseous products are removed through a flue above the converter. Some other combustion products from this reaction are taken into a layer of slag on the liquid steel surface and some leave as gaseous products through the flue. Such lances normally have a central duct for the oxygen surrounded by a double sleeve forming annular ducts for the supply and removal of cooling liquid.

In steel refining, the starting materials are often a mixture of liquid pig iron and scrap. The quantity of scrap which can be added is dependent on, among other things, the temperature of the liquid pig iron and on the amount of heat developed in the converter during the conversion of carbon to CO and $CO_2$ respectively. The more $CO_2$ that is formed, the more heat is developed and the more the scrap component can be increased.

In some cases it can be an advantage to combine the steel refining process with an injection of gas through the bottom of the vessel into the liquid steel. For instance, a better stirring effect can be achieved thereby. Such processes can, however, lead to an increased cooling of the bath which reduces the amount of scrap which can be added.

Especially if the price of scrap is low, it is desirable that the steel manufacturing process should allow a large scrap component.

One way of effecting this is to provide a secondary supply of oxygen from the lance which is blown obliquely from the side of the lance to form an oxygen screen around the burning spot. CO gas being formed at the burning spot is given off, and encounters the oxygen screen where it is burnt to $CO_2$. In this way extra heat is supplied to the bath by way of radiation and convection from this secondary burning.

Lances with a secondary oxygen supply system are known. U.K. Pat. No. 1,349,069 (corresponding to U.S. Pat. No. 3,730,505) shows a lance in which the secondary oxygen is supplied to a plurality of nozzles in the side of the lance by an annular duct disposed between annular cooling liquid supply and removal ducts. U.K. Pat. No. 934,112 and U.S. Pat. No. 3,488,044 both show an annular duct for the supply of secondary oxygen immediately surrounding the central duct for the primary oxygen supply. U.S. Pat. No. 3,488,044 also suggests, as an alternative structure, that there is no separate supply duct for the secondary oxygen but that the secondary oxygen nozzles should be supplied from the primary oxygen supply duct.

SUMMARY OF THE INVENTION

An object of the present invention is to provide an improved lance having nozzles for secondary oxygen supply, particularly a lance having good resistance to thermal stress.

We have not found these prior structures to be entirely satisfactory. Instead, we propose that the secondary oxygen supply should be delivered to the nozzles along a plurality of separate supply conduits arranged in parallel within the lance. Preferably there is one supply conduit per nozzle. The supply conduits can conveniently run within an annular duct for the conveyance of cooling liquid.

A particularly advantageous structure is to provide the supply conduits as pipes which, for a part of their length at least, take the form of a winding around the axis of the lance. A helical winding is convenient. This structure has especially good abilities to withstand the stresses caused by thermal expansion of the lance in use, while being simple to construct.

It should be noted that the object of the secondary oxygen supply is not to increase the size of the burning spot. Rather, it is to produce additional combustion at a distance from the burning spot so that the surface of the bath is heated over an increased area. It is important that the secondary oxygen should not be supplied too close to the burning spot or the proportion of the CO burnt will decrease with a corresponding reduction in the heat gain. Equally, if the secondary oxygen is too far from the surface of the bath the burning of the CO is not effective at heating the bath.

It appears that the best results can be achieved if the nozzles are located at a distance of 1 to 5 times, and preferably 2 to 3 times the lance tip diameter from the lance tip.

Theoretically the most even supply of secondary oxygen would be achieved if only one secondary supply line exit extended in a slit-shape around the lance. This would be the best approach to a closed oxygen screen. However, it appears that in practice a limited number of separate nozzles is adequate. Good results are achieved with 6 to 10 secondary supply lines.

Besides the height of the nozzles above the lance head, the angle at which the secondary oxygen is blown downwards has an effect on the combustion of the secondary CO. This angle is important for the shape of the post-combustion flame and it depends on the whole flow behaviour of the gas within the converter. It was found that the best results can be obtained if the secondary supply lines have exits at an angle between 35° and 65° to the lance axis.

To obtain good post-combustion of the CO gas developed in the bath, the mutual interaction of the primary oxygen jet and the secondary oxygen jets must be limited as much as possible. To this end it is preferable that the secondary $O_2$ is angled at at least 35° to the lance axis. Also it is important that, in contrast to the primary oxygen jets, the conical secondary oxygen jets have a reasonably small included angle, in order to reduce the speed of the secondary oxygen towards the wall of the bath. To this end it is preferable that the secondary exit holes should not have a diverging exit region and that the angle between the exit direction and the lance axis should not be greater than 65°.

BRIEF DESCRIPTION OF THE DRAWINGS

An embodiment of the invention, given by way of example, will now be described with reference to the accompanying drawings, in which.

DESCRIPTION OF THE PREFERRED EMBODIMENT

Figure 1:
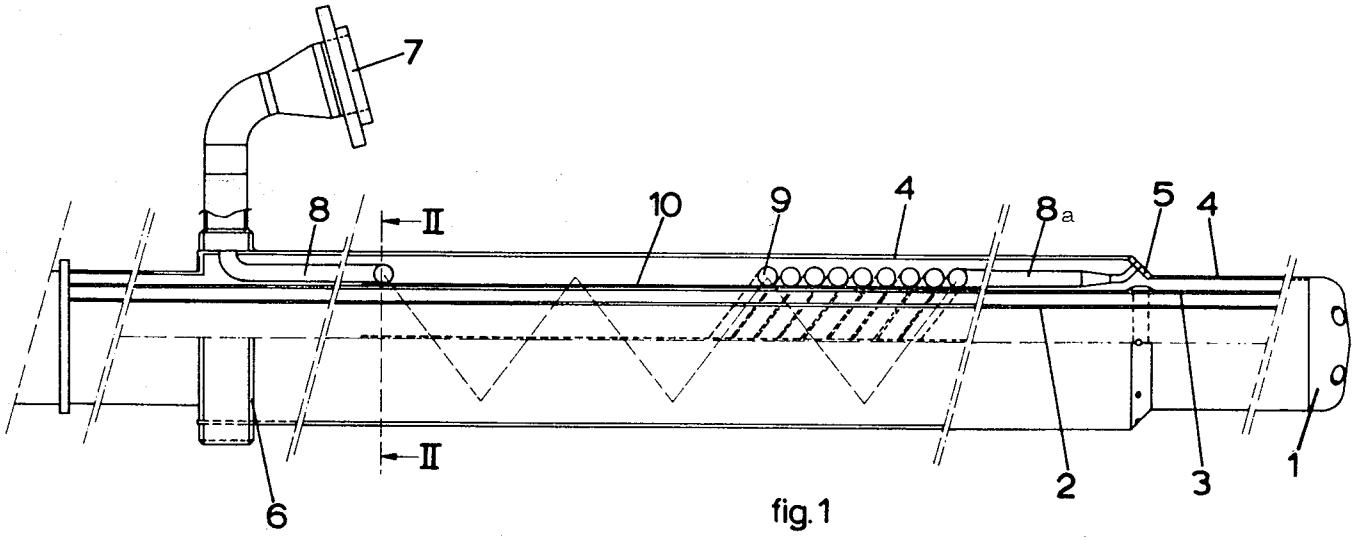
FIG. 1 shows a lance embodying the invention partly in side view and partly in longitudinal section.

In FIG. 1 there is shown a water-cooled oxygen lance embodying the invention which is drawn in side elevation on one side of the centre line and on the other side in longitudinal section. The lance has a lance tip 1 of a conventional type with two of the three oxygen holes depicted. Oxygen is supplied to the lance tip through a central duct formed by a tube 2. Around this tube 2 there is arranged a double tube system in the form of coaxial sleeves 3 and 4 through which coolant, such as water, is in operation supplied and removed.

In this respect the lance is of a conventional construction, and so these features need not be described in detail.

There is a conical portion 5 in the outer sleeve 4 at a distance L from the lance tip, this distance being about $2 \times D$, the diameter of the lance tip. From this conical widening 5 the outer sleeve 4 is cylindrical up to the rear end of the lance. There it connects to an annular duct 6 around the lance, which in its turn is connected via a connection element to a coupling flange 7. Flange 7 can be connected to a source of secondary oxygen, with a measurement and control circuit (not shown) separate from that for the primary oxygen. From the annular chamber 6 there run eight pipes 8, initially parallel to the axis in the outer sleeve 4. At about halfway down the lance the pipes 8 are given a few helical turns around the inner sleeve 3 of the lance. These curved tube components 9 lead to further straight tube sections 8*a*, which in turn exit at the conical portion 5.

Figure 2:
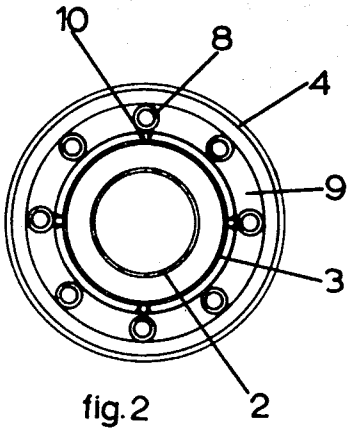
FIG. 2 is a transverse section at II—II of FIG. 1.

To support the helical tube sections 9 on the inner sleeve 3 there are ridges 10 spaced circumferentially around it. FIG. 2 shows the lance in transverse section at II—II of FIG. 1, where the transition from the straight tube sections 8 to helical ones can be seen and from which it is clear how the tube sections 9 are kept at a distance from the sleeve 3 by the ridges 10. The cooling liquid can thus flow freely around tube sections 8*a* and 9 in the outer sleeve. This assists the helical tube sections 9 in preventing or reducing thermal stresses from occurring in these tube sections.

Figure 3:
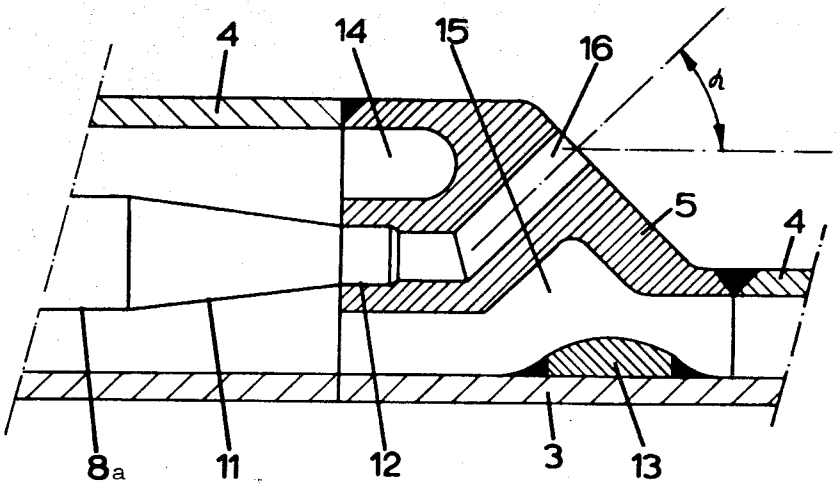
FIG. 3 shows a detail of FIG. 1 in the region of the secondary oxygen supply nozzles.

FIG. 3 shows on a larger scale the ends of the tubes 8 at the conical widening 5. The sleeve 4, which forms the radially outer wall of the radially outer coolant duct, is formed here by a ring-shaped member, preferably of pure copper. The tube sections 8*a* run into narrowed exit pipes 12 in a radially extending face of the ring shaped member via transition sections 11. These exit pipes 12 lead to secondary oxygen supply nozzles 16 which are at an angle $\alpha$ to the centre line of the lance. In the case shown $\alpha$ is 45°. Radially outwards of the exit pipes 12 the radial face of the ring-shaped member has an annular axially upwardly open recess 14. The radially inner circumferential face of the ring-shaped member has a radially directed annular recess 15. These recesses 14 and 15 increase the surface area of the ring-shaped member available to cooling fluid. Additionally they reduce the bulk and thickness of the ring-shaped member. The sleeve 3, which forms the radially inner wall of the coolant duct in question, has an outwardly projecting annular ridge 13 generally opposite the annular recess 15. This is intended to affect favourably the flow of coolant in this area when the lance is thermally expanded.

What is claimed is:

1. In a liquid-cooled lance for blowing oxygen onto a bath of molten steel, the lance having a tip from which a primary supply of oxygen is blown onto the bath, a rear end opposite the tip, a central duct for the delivery of the primary supply of oxygen to the tip, a double tube system outside the said central duct for the supply and removal of cooling liquid, a plurality of secondary nozzles disposed around the periphery of the lance and axially spaced from the tip through which a secondary supply of oxygen is blown onto the bath and means for the delivery of the secondary supply of oxygen to the secondary nozzles, the improvement that the said means for the delivery of the secondary supply of oxygen comprises a plurality of separate supply conduits arranged in parallel within the lance, the said separate supply conduits for the secondary nozzles being connected to a common external oxygen supply conduit at the rear end of the lance.

2. The lance of claim 1 in which each said supply conduit delivers oxygen to only one said secondary nozzle.

3. The lance of claim 1 in which the said plurality of separate supply conduits comprise a plurality of pipes disposed within the lance outside the central duct which pipes are in the form of a winding around the axis of the lance for at least a part of their length.

4. The lance of claim 1 in which the said nozzles are disposed at an axial distance from the said tip which distance is between 2 times and 3 times the diameter of the lance at the said tip.

5. The lance of claim 1 in which there are from 6 to 10 said secondary nozzles.

6. The lance of claim 1 in which the secondary oxygen supply is blown onto the bath at an angle of 35° to 65° to the lance axis.

7. The lance of claim 1 in which the said supply conduits run within an annular duct of the said double tube system for the conveyance of cooling liquid within the lance.

8. The lance of claim 7 in which the secondary nozzles comprise bores through the radially outer wall of the annular duct.

9. The lance of claim 8 in which the said supply conduits connect with a radially extending face of ring-shaped member forming a part of the radially outer wall of the annular duct, the nozzles comprising bores in the ring-shaped member, there being a first annular recess, located radially outwardly of the connection with the supply conduits, in the said radially extending face and a second annular recess located in the radially inner circumferential face of the ring-shaped member.

10. The lance of claim 9 in which the radially inner wall of the annular duct has an outwardly projecting annular ridge substantially opposite the said second annular recess.

11. The lance of claim 9 in which the said ring-shaped member is made of copper.

12. The lance of claim 1 in which the outer surface of the lance in the region of the secondary nozzles is conical, narrowing towards the tip of the lance.

13. A liquid-cooled lance for blowing oxygen onto a bath of molten steel, the lance having a tip from which a primary supply of oxygen is blown onto the bath, a rear end opposite the tip, a central longitudinal duct for the delivery of the said primary supply of oxygen to the tip, longitudinal ducts for the supply and removal of liquid coolant, a plurality of secondary nozzles disposed around the periphery of the lance and spaced axially of the lance from the said tip through which secondary nozzles a secondary supply of oxygen is blown onto the bath, and a plurality of separate longitudinal supply conduits arranged in parallel within the lance for the delivery of the said supply of oxygen to the said secondary nozzles.

* * * * *